US012467346B2

(12) United States Patent
Garrett et al.

(10) Patent No.: US 12,467,346 B2
(45) Date of Patent: Nov. 11, 2025

(54) ELECTRIC SUBMERSIBLE PUMP ASSEMBLY

(71) Applicants: David Garrett, Bartlesville, OK (US); Luis Seczon, Fulshar, TX (US); Kevin Scarsdale, Broken Arrow, OK (US)

(72) Inventors: David Garrett, Bartlesville, OK (US); Luis Seczon, Fulshar, TX (US); Kevin Scarsdale, Broken Arrow, OK (US)

(73) Assignee: Oilfield Equipment Development Center Limited, Victoria (SC)

( * ) Notice: Subject to any disclaimer, the term of this patent is extended or adjusted under 35 U.S.C. 154(b) by 17 days.

(21) Appl. No.: 18/540,950

(22) Filed: Dec. 15, 2023

(65) Prior Publication Data

US 2025/0198265 A1 Jun. 19, 2025

Related U.S. Application Data

(63) Continuation of application No. 17/824,892, filed on May 25, 2022, now abandoned.

(51) Int. Cl.

| | |
|---|---|
| ***E21B 43/12*** | (2006.01) |
| ***F04D 13/08*** | (2006.01) |
| ***F04D 13/14*** | (2006.01) |

(52) U.S. Cl.

CPC ..... *E21B 43/128* (2013.01); *F04D 13/086* (2013.01); *F04D 13/14* (2013.01)

(58) Field of Classification Search

CPC ..... E21B 43/128; F04D 13/086; F04D 13/14

See application file for complete search history.

(56) References Cited

U.S. PATENT DOCUMENTS

| | | | | |
|---|---|---|---|---|
| 6,932,160 | B2 | 8/2005 | Murray et al. | |
| 7,188,669 | B2 | 3/2007 | Bullock et al. | |
| 7,841,395 | B2 | 11/2010 | Gay et al. | |
| 8,141,625 | B2 * | 3/2012 | Reid | E21B 43/128 166/265 |
| 8,955,598 | B2 | 2/2015 | Brown et al. | |
| 9,631,472 | B2 | 4/2017 | Reid et al. | |
| 9,638,014 | B2 | 5/2017 | Reid | |
| 9,765,608 | B2 | 9/2017 | Sims et al. | |
| 9,920,611 | B2 | 3/2018 | Reid et al. | |
| 2008/0093085 | A1 * | 4/2008 | Knight | E21B 43/128 166/105 |
| 2013/0068455 | A1 * | 3/2013 | Brown | E21B 36/006 166/66.4 |
| 2015/0159472 | A1 * | 6/2015 | Wolf | E21B 43/20 166/66.4 |
| 2016/0130923 | A1 | 5/2016 | Nowitzki et al. | |
| 2019/0309768 | A1 | 10/2019 | Todd et al. | |

* cited by examiner

*Primary Examiner* — D. Andrews
(74) *Attorney, Agent, or Firm* — Douglas H. Elliott; Nathan Q. Huynh; My Idea Law PLLC

(57) ABSTRACT

Disclosed herein are electric submersible pump assemblies and methods for pumping wellbore fluid that may each include an electric submersible pump assembly which may include: a shroud that may include: a first shroud aperture; and a second shroud aperture; a first pump disposed in the shroud, wherein the first pump may be capable of pumping wellbore fluid that has flowed through the first shroud aperture; and a second pump disposed in the shroud, wherein the second pump may be capable of pumping out of the second aperture wellbore fluid that has flowed through the first shroud aperture.

15 Claims, 6 Drawing Sheets

ELECTRIC SUBMERSIBLE PUMP ASSEMBLY

CROSS REFERENCE TO RELATED APPLICATIONS

This application is a continuation of and claims benefit to U.S. Nonprovisional application Ser. No. 17/824,892, filed on May 25, 2022; and this application hereby incorporates herein U.S. Nonprovisional application Ser. No. 17/407,952, and all amendments thereto as if set forth herein in its entirety.

BACKGROUND

1. Field of Inventions

The field of this application and any resulting patent is electric submersible pumps.

2. Description of Related Art

Various electric submersible pump assemblies and methods for pumping fluids from a wellbore have been proposed including prior art of electric submersible pump assemblies listed on this patent. However, those assemblies and methods lack the combination of steps and/or features of the assemblies and methods claimed herein. Furthermore, it is contemplated that the assemblies and/or methods disclosed herein, including those claimed, solve at least some of the problems those prior art assemblies and methods have failed to solve. Also, it is contemplated that the assemblies and/or methods claimed herein have benefits that would be surprising and unexpected to a hypothetical person of ordinary skill with knowledge of the prior art existing as of the filing date of this application.

SUMMARY

The disclosure herein includes electric submersible pump assemblies and methods for pumping wellbore fluid that may each include an electric submersible pump assembly which may include: a shroud that may include: a first shroud aperture; and a second shroud aperture; a first pump disposed in the shroud, wherein the first pump may be capable of pumping wellbore fluid that has flowed through the first shroud aperture; and a second pump disposed in the shroud, wherein the second pump may be capable of pumping out of the second aperture wellbore fluid that has flowed through the first shroud aperture.

Additionally, the disclosure herein includes electric submersible pump assemblies and methods for pumping wellbore fluid that may each include an electric submersible pump assembly which may include: a shroud that may include: a first shroud portion; and a second shroud portion; a first pump disposed in the shroud, wherein the second pump is capable of pumping wellbore fluid past the first shroud portion; and a second pump disposed in the shroud wherein the second pump is capable of pumping wellbore fluid out through the second shroud portion.

Also, the disclosure herein includes electric submersible pump assemblies and methods for pumping wellbore fluid that may each include an electric submersible pump assembly which may include: a shroud that may include: a first shroud aperture; and a second shroud aperture; a first pump disposed in the shroud; a second pump disposed in the shroud, wherein the second pump may be capable of pumping wellbore fluid out of the second shroud aperture; a motor; and a shaft rotatably coupled to the motor, the first pump, and the second pump.

Further, the disclosure herein includes electric submersible pump assemblies and methods for pumping wellbore fluid that may each include an electric submersible pump assembly which may include: a shroud; a first pump disposed in the shroud; a second pump disposed in the shroud; and an intake conduit disposed between the first pump and the second pump, wherein the intake conduit may have: a first intake aperture in fluid communication with the first pump; and a second intake aperture in fluid communication with the second pump.

In addition, the disclosure herein includes electric submersible pump assemblies and methods for pumping wellbore fluid that may each include an electric submersible pump assembly which may include: a shroud that that may include: a first shroud portion having a first shroud aperture; and a second shroud portion having a second shroud aperture; a first pump disposed in the shroud, wherein the first pump may be capable of pumping wellbore fluid that have flowed pass the second shroud portion and then through the first shroud aperture; and a second pump disposed in the shroud.

Furthermore, the disclosure herein includes electric submersible pump assemblies and methods for pumping wellbore fluid that may each include an electric submersible pump assembly which may include: a shroud that that may include: a first shroud portion having a first shroud aperture capable of receiving wellbore fluid therethrough; and a second shroud portion having a second shroud aperture capable of receiving wellbore fluid therethrough; a first pump disposed in the shroud; a second pump disposed in the shroud; an intake conduit disposed between the first pump and the second pump, the intake conduit having: a first intake aperture, wherein the first pump may receive wellbore fluid entering the first intake aperture; and a second intake aperture, wherein the second pump may be capable of receiving wellbore fluid that have flowed through the second intake aperture; a motor; a shaft rotatably coupled to the motor, the first pump, and the second pump.

Moreover, the disclosure herein includes methods for pumping wellbore fluid that may each include: providing an electric submersible pump assembly that may include: a shroud that may include: a first shroud portion; and a second shroud portion; a first pump disposed in the shroud; and a second pump disposed in the shroud; drawing wellbore fluid from the wellbore into the shroud; pumping, with the first pump, a portion of the wellbore fluid in the shroud in a first direction; pumping, with the second pump, a portion of the wellbore fluid in the shroud in a second direction, opposite the first direction.

The disclosure herein includes methods for pumping wellbore fluid that may each include: providing an electric submersible pump assembly that may include: a shroud that may include: a first shroud aperture; and a second shroud aperture; a first pump disposed in the shroud; a second pump disposed in the shroud; a motor; and a shaft rotatably coupled to the motor, the first pump, and the second pump; rotating the shaft with motor; actuating the first pump and the second pump with the rotating shaft; pumping, with the actuated first pump, wellbore fluid in a first direction; pumping, with the actuated second pump, wellbore fluid in the shroud in a second direction, opposite the first direction.

DETAILED DESCRIPTION

1. Introduction

Figure 1:
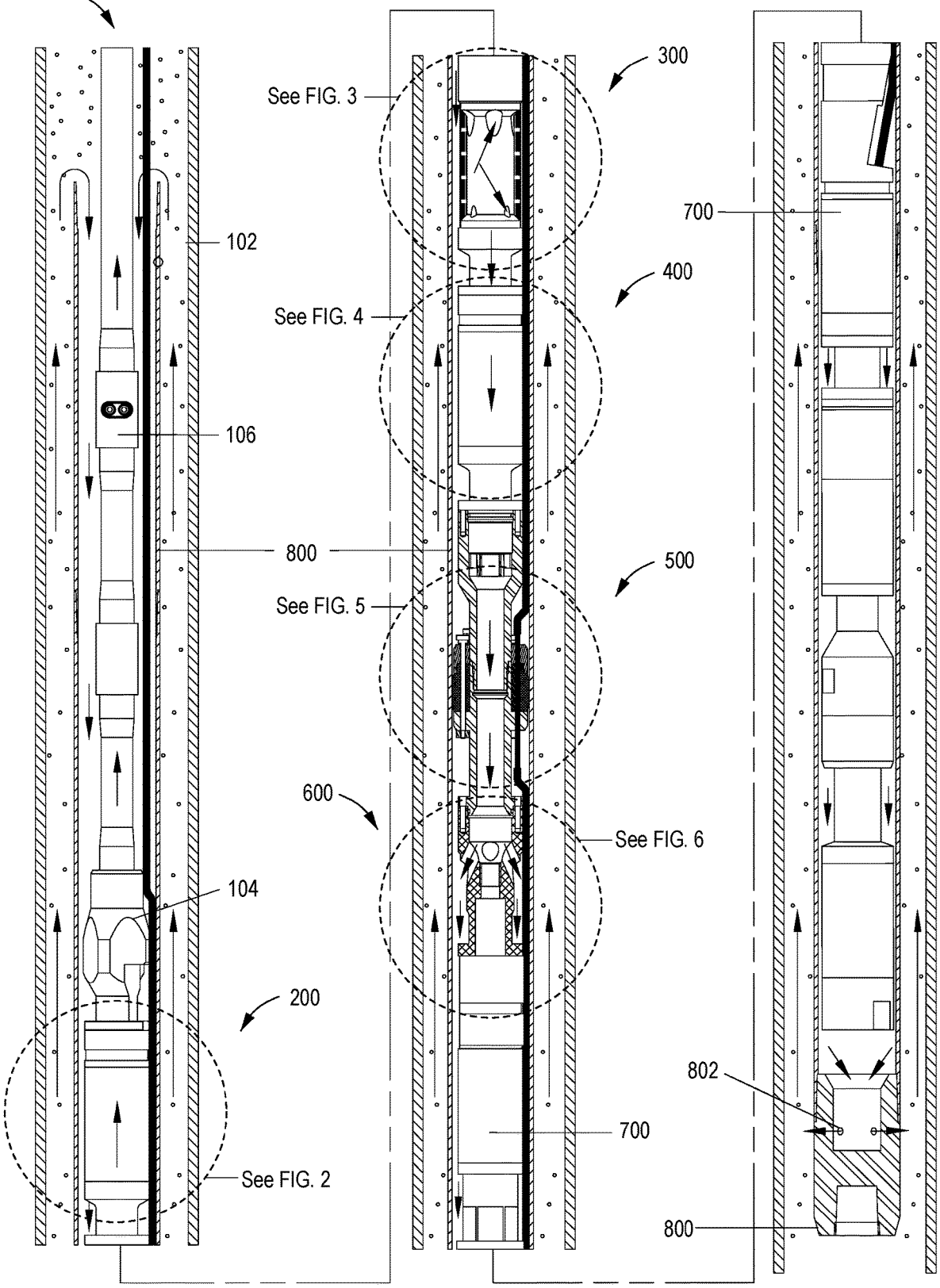
FIG. 1 illustrates a cross-sectional side view of an electrical submersible pump assembly disposed in a wellbore.

A detailed description will now be provided. The purpose of this detailed description, which includes the drawings, is to satisfy the statutory requirements of 35 U.S.C. § 112. For example, the detailed description includes a description of inventions defined by the claims and sufficient information that would enable a person having ordinary skill in the art to make and use the inventions. In the figures, like elements are generally indicated by like reference numerals regardless of the view or figure in which the elements appear. The figures are intended to assist the description and to provide a visual representation of certain aspects of the subject matter described herein. The figures are not all necessarily drawn to scale, nor do they show all the structural details, nor do they limit the scope of the claims.

Each of the appended claims defines a separate invention which, for infringement purposes, is recognized as including equivalents of the various elements or limitations specified in the claims. Depending on the context, all references below to the "invention" may in some cases refer to certain specific embodiments only. In other cases, it will be recognized that references to the "invention" will refer to the subject matter recited in one or more, but not necessarily all, of the claims. Each of the inventions will now be described in greater detail below, including specific embodiments, versions, and examples, but the inventions are not limited to these specific embodiments, versions, or examples, which are included to enable a person having ordinary skill in the art to make and use the inventions when the information in this patent is combined with available information and technology. Various terms as used herein are defined below, and the definitions should be adopted when construing the claims that include those terms, except to the extent a different meaning is given within the specification or in express representations to the Patent and Trademark Office (PTO). To the extent a term used in a claim is not defined below or in representations to the PTO, it should be given the broadest definition persons having skill in the art have given that term as reflected in at least one printed publication, dictionary, or issued patent.

2. Selected Definitions

Certain claims include one or more of the following terms which, as used herein, are expressly defined below.

The term "adjacent" as used herein means next to and may include physical contact but does not require physical contact.

The term "aligning" as used herein is defined as a verb that means manufacturing, forming, adjusting, or arranging one or more physical objects into a particular position. After any aligning takes place, the objects may be fully or partially "aligned." Aligning preferably involves arranging a structure or surface of a structure in linear relation to another structure or surface; for example, such that their borders or perimeters may share a set of parallel tangential lines. In certain instances, the aligned borders or perimeters may share a similar profile.

The terms "annular barrier" and "barrier" mean any structure that when disposed in a wellbore, e.g., an annular space within a wellbore, is capable of preventing, inhibiting, or impeding the passage of fluid, e.g., reservoir water, past the structure from one part of the wellbore, e.g., one part of the annular space (e.g., above the structure) to another part of the wellbore, e.g., another part of the annular space (e.g., below the structure). At least one non-limiting example of an annular barrier is a seal which is preferably a packer. A "seal" is defined as an annular barrier that when disposed in an annular space has sealing contact with the surfaces forming the annular space and thus provides a seal that helps in the prevention of fluid passing past the seal from one part of the annular space (e.g., a first annular space) to another part of the annular space (e.g., a second annular space). At least one non-limiting example of a seal is a packer.

The term "annular space" means any space having an annular form, e.g., the cylindrical space between the inside surface of a wall of an outer conduit, e.g., a shroud illustrated in FIG. 1A, and an outside surface of a wall of an inner conduit, e.g., a string of electric submersible pump assembly components illustrated in FIG. 1A. As discussed below, an annular space may also include multiple annular spaces, e.g., a first annular space, which may also be referred to as an upper annular space, and a second annular space, which may also be referred to as a lower annular space.

The term "aperture" as used herein is defined as any opening in a solid object or structure. For example, an aperture may be an opening that begins on one side of the solid object and ends on the other side of the object. An aperture may alternatively be an opening that does not pass entirely through the object, but only partially passes through, e.g., a groove. An aperture can be an opening in an object that is completely circumscribed, defined, or delimited by the object itself. Alternatively, an aperture can be an opening in the object formed when the object is combined with one or more other objects or structures. One or more apertures may be disposed and pass entirely through a casing, a conduit, and/or a pump. An aperture may receive another object and permit ingress and/or egress of the object through the aperture. Non-limiting examples of apertures herein are perforations, entry ports, and exit ports.

The term "assembly" as used herein is defined as any set of components that have been fully or partially assembled together. A group of assemblies may be coupled to form a combined assembly, e.g., a body having an inner surface and an outer surface.

The term "bearing assembly" as used herein is defined as an assembly capable of supporting a shaft assembly as it rotates. In some cases, a bearing assembly does not physically touch a shaft assembly. A bearing assembly may be disposed concentrically around a shaft assembly, as shown in FIGS. 3, 4A, 5, and 6. A bearing assembly may include a bushing, e.g., a sleeve. A bearing assembly may receive a rotatable shaft assembly therethrough, in which a clearance may exist between surfaces of the bearing assembly and the shaft. A bearing assembly may include an axial support bearing, a journal bearing, or a thrust bearing. A bearing assembly may be disposed at each end of a shaft assembly A bearing assembly may be disposed on a rotor. Two bearing assemblies may be disposed on a rotor, separated by a length of the rotor between the bearing assemblies.

The term "axis" as used herein is defined as any actual or imaginary line running through the center of an object or structure.

The term "conduit" as used herein is defined as a structure through which a channel is provide for fluid to flow. A conduit may include a shroud, a motor, a packer, and a tubular.

The term "coupled" as used herein is defined as directly or indirectly connected, attached, or integral with, e.g., part of. A first object may be coupled to a second object such that the first object is positioned at a specific, or pre-determined, location and orientation with respect to the second object. For example, a housing in which is disclosed an impeller may be coupled at the upper end to a conduit, e.g., the "second conduit" disclosed elsewhere herein. A first object may be either permanently or removably coupled to a second object. Two objects may be "permanently coupled" to each other via adhesive or welding; or they may be "removably coupled" via collets, screws, threading, or nuts and bolts such that they are capable of being easily separated and no longer coupled. Thus, a portion of a housing may be removably coupled to a seal such that the portion of the housing may then be uncoupled and removed from the seal. Two objects may be "rotatably coupled" together, e.g., where a first object may be rotated relative to a second object. For example, a shaft may be rotatably coupled to a body in a pump where the shaft may be rotated relative to the body. Two objects may be "sealingly coupled,", e.g., where a first object may be abutted to a second object such that respective adjacent surfaces of the objects would be inhibited fluid from flowing therebetween. For example, a seal may be sealingly coupled to a fluid conduit where, in some cases, fluid cannot flow between adjacent surfaces of the seal and fluid conduit.

The term "cylindrical" as used herein is defined as shaped like a cylinder, e.g., having straight parallel sides and a circular or oval or elliptical cross-section. A cylindrical body or structure, e.g., housing, shaft assembly, or bearing assembly, may be completely or partially shaped like a cylinder. A cylindrical body, e.g., shaft assembly or housing, which has an outer diameter that changes abruptly may have a radial face or "lip" extending toward the center axis. A cylindrical body may have an aperture, e.g., borehole, which extends through the entire length of the body to form a hollow cylinder that is capable of permitting fluid to pass through, e.g., water or hydrocarbon. On the other hand, a cylindrical structure may be solid, e.g., rod or peg. A drive shaft assembly is an example of a solid cylindrical body.

The term "disposed" as used herein means having been put, placed, positioned, inserted, or oriented in a particular location. For example, when a second conduit occupies a position within a first conduit, the second conduit is disposed in or within the first conduit. Also, a conduit or some other type of structure or aperture may be disposed on or disposed adjacent another structure or space.

The term "electric submersible assembly" means an assembly of components that include one or more shrouds, pumps, motors, conduits, and sensors that are disposed in a wellbore.

The term "elongated" as used herein describes something that has a length and width wherein the length is greater than the width and is preferably 5 or more times as long as it is wide. For example, the first and second conduits, and the first and second annular spaces disclosed herein are "elongated" given their lengths are substantially greater than their widths, e.g., outer diameters.

The term "entry port" means an aperture in a structure, e.g., a housing or a wall of a structure, through which fluid, e.g., reservoir fluid, is capable of passing, from outside the structure to the interior of the structure.

The term "exit port" means an aperture in a structure, e.g., a housing or a wall of a structure, through which fluid, e.g., reservoir fluid, passes from the interior of the structure, e.g., the housing or conduit, to outside the structure. A "discharge port" may be an exit port.

The terms "first," "second," "third," and other ordinal terms, when used to refer to certain things, e.g., structures, are terms that differentiate those things from one another and do not mean or imply anything in terms of importance, sequence, etc.

The term "flow" as used herein, as a verb, noun, or word that modifies another word, e.g., volume, describes or refers to the moving, or the movement or passage of a fluid, preferably substantially in a particular direction. For example, reservoir fluid may flow in a downward direction in the interior of a conduit or an annular space. Such flow can be laminar or turbulent, or a combination of laminar and turbulent. Flow volume in that context may be measured in a variety of units, e.g., gallons or liters. Time may be measured in seconds, minutes, or hours.

The term "fluid" as used herein is defined as a material that is capable of flowing. A fluid may be a liquid or a gas or some mixture of liquid and gas. A fluid may absorb heat. A fluid has inherent properties which may in certain embodiments are measurable, such as viscosity, anti-foaming, thermal stability, thermal conductivity, and thermal capacity.

The term "horizontal wellbore" as used herein is defined as a wellbore that has been drilled using some type of directional drilling technique and includes at least a portion that is more than 45 degrees from vertical. However, at least a portion of any horizontal wellbore is vertical or at least substantially vertical, as the term "vertical" is used in the oil and gas industry, i.e., pointed toward the center of the earth. For example, the upper portion of the wellbore closest to the surface is typically vertical, or substantially vertical, and the lower portion is less vertical and closer to perfectly horizontal relative to the earth's surface above that portion of the wellbore. For example, a horizontal wellbore may include a wellbore that is formed as a kick-out wellbore from an originally drilled vertical wellbore. Any horizontal wellbore mentioned herein is defined to include a "heel," which is the part, point, or section of the wellbore where the portion of the wellbore changes from being vertical to being horizontal, and the "toe" which refers to the end of the wellbore. In any discussion of wellbores herein, there is no restriction in length unless stated specifically otherwise, a central part of any elongated space, such as a conduit.

The term "impeller" as used herein is defined as a structure that is part of a pump, and that is capable of rotating relative to some other structure, surface, body and/or a housing. An impeller, when rotating, may cause flow of fluid, e.g., water, lubricant, or hydrocarbon. An impeller may be coupled to a rotatable shaft. One or more impellers may be disposed in a pump.

The term "perforation" means an aperture created as a result of perforating.

The term "port" as used herein is defined as an aperture in a structure for providing the ingress or egress of fluid.

The term "pressure" as used herein means force(s), including but not limited to the forces exerted in every direction in an enclosed space, e.g., forces applied against the inside surfaces of any structure defining the enclosed space. Pressure may be, for example, exerted against a surface of an object, e.g., rotor, piston head, seat, and/or dart, from the fluid flow across the surface. Non-limiting examples of pressure include: (a) the formation pressure in a reservoir, including the formation pressure of the upper part of the reservoir adjacent to one or more of the upper perforations in the upper part of the first conduit, e.g., the upper part of the casing; (b) pressure in one of the annular spaces inside the wellbore, e.g., the pressure in the first annular space, between the inner surface of the upper part of the first conduit, e.g., the casing, and the outer surface of the upper part of the second conduit, and above the seal (e.g., packer); (c) pressure inside the second conduit; (d) pressure inside the second annular space, between the inner surface of the lower part of the first conduit, e.g., the lower part of the casing, and the outer surface of the lower part of the second conduit, and below the seal (e.g., packer); and (e) the formation pressure of the lower part of the reservoir adjacent to one or more of the lower perforations in the first conduit, e.g., the lower part of the casing. Although pressure is normally measured in kilopascals, kilopascals can be converted to joules, as a unit of energy, to combine with potential energy. Thus, pressure (measured in joules) and potential energy (measured in joules) in a reservoir may be combined.

The term "providing" as used herein is defined as making available, furnishing, supplying, equipping, or causing to be placed in position.

The term "reservoir" as used herein is defined as a volumetric space that contains fluid, e.g., lubricant, or is capable of containing fluid. A reservoir may be used to store fluid. A reservoir may be artificial or man-made, i.e., manufactured by humans, or it may be natural, i.e., existing in nature, such as an underground reservoir containing water or hydrocarbons. An example of a natural reservoir may be a body of rock and/or sediment that holds groundwater (also known as an aquifer). An artificial fluid reservoir may be defined by a housing, e.g., having walls. A reservoir may become depleted of material, e.g., hydrocarbon, which was once present in the reservoir such that pressure in the depleted reservoir is less than when material was present. Accordingly, pressure in an aquifer may be greater than pressure in a depleted reservoir below the aquifer. Groundwater may flow from the higher-pressure aquifer to the lower-pressure, depleted reservoir if a flow path were provided from one reservoir to the other. A reservoir may be defined by the inner surface of a housing and one or more surfaces of a body, e.g., group of coupled assemblies, disposed within the housing. A reservoir may have an upper end and a lower end with walls extending from or between the upper end and the lower end. Fluid may flow within a reservoir. For instance, an impeller may be disposed within a reservoir such that turning the impeller generates differential pressure to cause fluid to flow from one end of the fluid reservoir to the other. A reservoir may be in fluid communication with a flow path. Preferably, an upper end of the reservoir may be in fluid communication with an upper end of a flow path and a lower end of the fluid reservoir may be in fluid communication with a lower end of the flow path, thereby forming a fluid circulation loop.

The term "seal" as used herein as a noun is defined as a structure that is capable of providing sealing contact when pressed or abutted against or otherwise in contact with some surface. A portion of the seal may be coupled to or abutted against a surface of a structure such that, in some cases, fluid is inhibited or even prevented from passing between the seal and the surface of the structure. A seal may be or include, for example, an O-ring or a packer. At least one non-limiting preferred example of a seal is a packer which, as illustrated in some of the drawings herein, is cylindrical and is disposed in the annular space between a first conduit and a second conduit, such that there is preferably a first annular space and a second annular space with the packer separating the two annular spaces. In that specific embodiment, the outer surface of the packer is pressed against the inner surface of the first conduit, and the inner surface of the packer is pressed against the outer surface of the second conduit. Preferably, the packer provides sealing contact with the surfaces of the conduits, and thus inhibits and preferably prevents fluid from passing past the areas of sealing contact, even when there is a substantial pressure difference between the first and second annular spaces.

The term "packer" is to be given its usual and customary meaning within the oil and gas industry, encompassing any type of structure that has been used in the past in oil wells and referred to as a "packer."

The term "pump" as used herein is defined as an assembly that includes a shaft and an impeller for driving movement of an object, e.g., fluid, hydrocarbon, gas, and solids. Movement of an object may include rotation of the object on a central axis. Additionally, movement may include radial displacement or axial displacement of an object relative to another object. A pump may be a progressive cavity positive displacement pump having one or more rotatable portions, e.g., drive shaft and/or rotors, having fins or blades extending from each rotatable portion. Fluid may flow across vanes, e.g., fins or blades, of a pump. A pump may include a housing and one or more rotatable portions, e.g., drive shaft and/or rotors, having fins or blades extending from each rotatable portion, disposed in the housing. A pump may include a pump housing having one or more ports disposed therethrough. The one or more ports may extend longitudinally, e.g., parallel to the central axis of the pump, and disposed radially around the housing. The one or more ports may have circular profiles. Alternatively, one or more ports may be elongated. The one or more ports port may extend at an angle relative to the central axis of a pump housing. A pump may include a drive shaft assembly capable of being coupled to a shaft assembly of a motor.

The term "shaft assembly" as used herein is defined as an assembly capable of rotating about an axis, e.g., an elongated shaft having an axis. One type of shaft assembly may be or include a shaft and bearings. A shaft assembly may include one or more impellers coupled to a shaft. A shaft may be rotatably coupled to a pump body and/or a motor. A shaft assembly may be formed from two coupled shaft assemblies. Torque and axial load may be transferred from a first shaft assembly to a second shaft assembly, e.g., rotor.

The term "shroud" as used as noun herein is defined as a housing. A shroud is, preferably a cylindrical sleeve, configured to be filled with fluid, e.g., wellbore fluid, hydrocarbon, water, gas. A shroud is to be given its usual and customary meaning within the oil and gas industry, encompassing any type of structure that has been used in the past in oil and/or gas wells and referred to as a "shroud." A shroud may have a central aperture. A shroud may have an upper opening. A shroud may have an upper aperture, e.g., for ingress of wellbore fluid. A shroud may have a lower aperture, e.g., for egress of wellbore fluid. A shroud may have disposed therein one or more electric submersible components, e.g., motors, motor seals, sensors, packers, power sections, seal sections, and pumps. A shroud may have a first portion open to ingress of fluid and a second portion open to egress of fluid.

The term "space" as used herein means any volumetric space. For example, it may refer to some empty volume between two objects, structures, points, lines, edges, or surfaces, i.e., not occupied by any anything solid. A non-limiting example of space is "annular space," e.g., the space between the inside surface of one conduit and the outside surface of another conduit disposed inside the one conduit.

The term "surface" as used herein is defined as any boundary of a structure. A surface may also refer to that cylindrical area that extends radially around a cylinder which may, for example, be part of a shaft assembly or bearing assembly. A surface may also refer to that cylindrical area that extends radially around a cylinder which may, for example, be part of a housing, a stator, a rotor, or a shaft assembly. A "surface" may have any geometry, e.g., curved or flat. A surface may have irregular contours. A surface may be formed from components, e.g., bearing assemblies, bodies, and/or housings, coupled together. Coupled components may form irregular surfaces.

The term "unitary" as used herein means having the nature, properties, or characteristics of a single unit. For example, a shaft and a rotor may be unitary where they are connected, directly or indirectly, and fulfill the intended purpose of being rotated. Also, a shaft and an impeller may be unitary where they are connected, directly or indirectly, and fulfill the intended purpose of being rotated to move fluid, e.g., water, hydrocarbon, or lubricant.

The terms "upper" and "lower" as used herein are relative terms describing the position of one object, thing, or point positioned in its intended useful position, relative to some other object, thing, or point also positioned in its intended useful position, when the objects, things, or points are compared to distance from the center of the earth. For example, the term "upper" identifies any object or part of a particular object that is farther away from the center of the earth than some other object or part of that particular object, when the objects are positioned in their intended useful positions.

The term "well" as used herein is defined as the wellbore in combination with any related surface equipment outside the wellbore, such as pumps and piping, and also the area surrounding the wellbore such as the formation, including the hydraulic fractures.

The term "wellbore" as used herein is defined as the drilled elongated cylindrical borehole extending through the formation from the surface, where the drilling was initiated, to the endpoint where the drilling was terminated. Depending on the context, the term may also include any downhole components placed within the borehole, e.g., casing, cement, tubing, packers, etc.

The term "wellbore fluid" means any fluid in a wellbore, including liquid, gas, or a mixture of liquid and gas, which existed in or originated from a subterranean reservoir or that is or was at some point present in the subterranean reservoir, including underground water which may be fresh, potable, or salt water.

3. Certain Specific Embodiments

The disclosure herein includes electric submersible pump assemblies and methods for pumping wellbore fluid that may each include an electric submersible pump assembly which may include: a shroud that may include: a first shroud aperture; and a second shroud aperture; a first pump disposed in the shroud, wherein the first pump may be capable of pumping wellbore fluid that has flowed through the first shroud aperture; and a second pump disposed in the shroud, wherein the second pump may be capable of pumping out of the second aperture wellbore fluid that has flowed through the first shroud aperture.

Additionally, the disclosure herein includes electric submersible pump assemblies and methods for pumping wellbore fluid that may each include an electric submersible pump assembly which may include: a shroud that may include: a first shroud portion; and a second shroud portion; a first pump disposed in the shroud, wherein the second pump is capable of pumping wellbore fluid past the first shroud portion; and a second pump disposed in the shroud wherein the second pump is capable of pumping wellbore fluid out through the second shroud portion.

Also, the disclosure herein includes electric submersible pump assemblies and methods for pumping wellbore fluid that may each include an electric submersible pump assembly which may include: a shroud that may include: a first shroud aperture; and a second shroud aperture; a first pump disposed in the shroud; a second pump disposed in the shroud, wherein the second pump may be capable of pumping wellbore fluid out of the second shroud aperture; a motor; and a shaft rotatably coupled to the motor, the first pump, and the second pump.

Further, the disclosure herein includes electric submersible pump assemblies and methods for pumping wellbore fluid that may each include an electric submersible pump assembly which may include: a shroud; a first pump disposed in the shroud; a second pump disposed in the shroud; and an intake conduit disposed between the first pump and the second pump, wherein the intake conduit may have: a first intake aperture in fluid communication with the first pump; and a second intake aperture in fluid communication with the second pump.

In addition, the disclosure herein includes electric submersible pump assemblies and methods for pumping wellbore fluid that may each include an electric submersible pump assembly which may include: a shroud that that may include: a first shroud portion having a first shroud aperture; and a second shroud portion having a second shroud aperture; a first pump disposed in the shroud, wherein the first pump may be capable of pumping wellbore fluid that have flowed pass the second shroud portion and then through the first shroud aperture; and a second pump disposed in the shroud.

Furthermore, the disclosure herein includes electric submersible pump assemblies and methods for pumping wellbore fluid that may each include an electric submersible pump assembly which may include: a shroud that that may include: a first shroud portion having a first shroud aperture capable of receiving wellbore fluid therethrough; and a second shroud portion having a second shroud aperture capable of receiving wellbore fluid therethrough; a first pump disposed in the shroud; a second pump disposed in the shroud; an intake conduit disposed between the first pump and the second pump, the intake conduit having: a first intake aperture, wherein the first pump may receive wellbore fluid entering the first intake aperture; and a second intake aperture, wherein the second pump may be capable of receiving wellbore fluid that have flowed through the second intake aperture; a motor; a shaft rotatably coupled to the motor, the first pump, and the second pump.

Moreover, the disclosure herein includes methods for pumping wellbore fluid that may each include: providing an electric submersible pump assembly that may include: a shroud that may include: a first shroud portion; and a second shroud portion; a first pump disposed in the shroud; and a second pump disposed in the shroud; drawing wellbore fluid from the wellbore into the shroud; pumping, with the first pump, a portion of the wellbore fluid in the shroud in a first direction; pumping, with the second pump, a portion of the wellbore fluid in the shroud in a second direction, opposite the first direction.

The disclosure herein includes methods for pumping wellbore fluid that may each include: providing an electric submersible pump assembly that may include: a shroud that may include: a first shroud aperture; and a second shroud aperture; a first pump disposed in the shroud; a second pump disposed in the shroud; a motor; and a shaft rotatably coupled to the motor, the first pump, and the second pump; rotating the shaft with motor; actuating the first pump and the second pump with the rotating shaft; pumping, with the actuated first pump, wellbore fluid in a first direction; pumping, with the actuated second pump, wellbore fluid in the shroud in a second direction, opposite the first direction.

Any one of the electric submersible pump assemblies or methods disclosed herein may further include a shaft rotatably coupled to the first pump and the second pump.

In any one of the electric submersible pump assemblies or methods disclosed herein, the first pump and the second pump may be disposed between the first shroud aperture and the second shroud aperture.

In any one of the electric submersible pump assemblies or methods disclosed herein, the second pump may be below the first pump.

In any one of the electric submersible pump assemblies or methods disclosed herein, the first pump may be capable of pumping wellbore fluid away from the second pump.

In any one of the electric submersible pump assemblies or methods disclosed herein, the second pump may be capable of pumping wellbore fluid away from the first pump.

In any one of the electric submersible pump assemblies or methods disclosed herein, the first pump may be capable of pumping wellbore fluid in a first direction and the second pump may be capable of pumping wellbore fluid in a second direction that is opposite the first direction.

In any one of the electric submersible pump assemblies or methods disclosed herein, the second pump may be capable of pumping wellbore fluid away from the first pump.

In any one of the electric submersible pump assemblies or methods disclosed herein, the first shroud portion may have a first shroud aperture through which wellbore fluid is capable of flowing into the shroud.

In any one of the electric submersible pump assemblies or methods disclosed herein, the second shroud portion has a second shroud aperture through which wellbore fluid is capable of flowing out of the shroud.

In any one of the electric submersible pump assemblies or methods disclosed herein, the first pump may be between the first shroud portion and the second pump.

In any one of the electric submersible pump assemblies or methods disclosed herein, the second pump may be between the first pump and the first shroud portion.

In any one of the electric submersible pump assemblies or methods disclosed herein, the motor, the first pump, and the second pump are disposed between the first shroud aperture and the second shroud aperture.

In any one of the electric submersible pump assemblies or methods disclosed herein, the second pump is capable of pumping through the second shroud aperture wellbore fluid that have flowed through the first shroud aperture.

In any one of the electric submersible pump assemblies or methods disclosed herein, the first pump is above the second pump.

Any one of the electric submersible pump assemblies or methods disclosed herein may further include a packer disposed in the shroud, where the packer is capable of inhibit wellbore fluid flow pass the packer.

Any one of the electric submersible pump assemblies or methods disclosed herein may further include a packer disposed in the shroud above the motor.

Any one of the electric submersible pump assemblies or methods disclosed herein may further include a shaft rotatably coupled to the first pump and the second pump.

In any one of the electric submersible pump assemblies or methods disclosed herein, the motor may be below the second pump.

In any one of the electric submersible pump assemblies or methods disclosed herein, the first intake aperture may have a first radius larger a second radius of the second intake aperture.

In any one of the electric submersible pump assemblies or methods disclosed herein, the first intake aperture may be above the second intake aperture.

In any one of the electric submersible pump assemblies or methods disclosed herein, wellbore fluid flowing through the second intake aperture may flow upwardly.

In any one of the electric submersible pump assemblies or methods disclosed herein, the wellbore fluid flowing through the second intake aperture may be capable of exiting the second shroud aperture.

In any one of the electric submersible pump assemblies or methods disclosed herein, the wellbore fluid flowing through the first intake aperture may flow towards the first pump.

In any one of the electric submersible pump assemblies or methods disclosed herein, the wellbore fluid flowing through the second intake aperture may flow downwardly.

In any one of the electric submersible pump assemblies or methods disclosed herein, the wellbore fluid entering the second intake aperture may flow towards the second pump.

In any one of the electric submersible pump assemblies or methods disclosed herein, the wellbore fluid entering the first shroud aperture may be capable of entering the first intake aperture and the second intake aperture.

Any one of the electric submersible pump assemblies or methods disclosed herein may further include a packer disposed in the shroud below the intake conduit.

Any one of the electric submersible pump assemblies or methods disclosed herein may further include a packer disposed in the shroud above the motor.

In any one of the electric submersible pump assemblies or methods disclosed herein, the second pump may be capable of pumping out of the second shroud aperture wellbore fluid that has flowed through the first shroud aperture.

In any one of the electric submersible pump assemblies or methods disclosed herein, the first pump may be above the intake conduit.

In any one of the electric submersible pump assemblies or methods disclosed herein, the first pump may below the intake conduit.

In any one of the electric submersible pump assemblies or methods disclosed herein, the first intake aperture has a first diameter that may be greater than second diameter of the second intake aperture.

In any one of the electric submersible pump assemblies or methods disclosed herein, the second shroud aperture may extend perpendicularly to a central axis of the shroud.

4. Specific Embodiments in the Drawings

The drawings presented herein are for illustrative purposes only and do not limit the scope of the disclosure or claims. Rather, the drawings are intended to help enable one having ordinary skill in the art to make and use the systems and assemblies and practice the methods disclosed herein.

This section addresses specific versions of electric submersible pump assemblies shown in the drawings, which include assemblies, elements and parts that can be part of one or more downhole wellbore systems or downhole methods for generating electricity. Although this section focuses on the drawings herein, and the specific embodiments found in those drawings, parts of this section may also have applicability to other embodiments not shown in the drawings. The limitations referenced in this section should not be used to limit the scope of the claims themselves, which have broader applicability than the structures disclosed in the drawings.

FIG. 1 illustrates a cross-sectional side view of an electric submersible pump (ESP) assembly 100 disposed in a wellbore. FIG. 1 depicts a wellbore that is a vertical wellbore, but it is understood that the ESP assembly 100 may also be used in a horizontal wellbore. A casing 102 lines inner surfaces of the wellbore for reinforcement. The ESP assembly 100 may be coupled, e.g., via a bolt on discharge head 104, to tubing extending from surface. The ESP assembly 100 may include a production pump 200, an intake conduit 300, an inverted pump 400, a packer 500, a discharge conduit 600, a motor 700, and a shroud 800. An upper end of the production pump 200 is coupled, e.g., via threads, to the bolt on discharge head 104. A lower end of the production pump 200 is coupled, e.g., via bolts, to an upper end of the intake conduit 300. A lower end of the of the intake conduit 300 is coupled, e.g., via bolts, to an upper end of the inverted pump 400. A lower end of the inverted pump 400 is coupled, e.g., via bolts, to an upper end of the packer 500. A lower end of the packer 500 is coupled, e.g., via bolts, to an upper end of the discharge conduit 600. A lower end of the discharge conduit 600 is coupled, e.g., via bolts, to an upper end of the motor 700.

Additional components such as sensors, e.g., temperature sensors, flow rate sensors, and pressure sensors, may be included on the ESP assembly 100. Those additional components along with the production pump 200, the intake conduit 300, the inverted pump 400, the packer 500, the discharge conduit 600, and the motor 700 are coupled to form a string disposed in the shroud 800. The shroud 800 is an elongated housing that has an upper shroud portion and a lower shroud portion. The upper shroud portion is coupled to a shroud hanger 106 that is coupled to the tubing extending from surface. The lower shroud portion has one or more exit ports 802 extending therethrough.

That ESP assembly 100 preferably has an annular space between the shroud 800 and the string of the production pump 200, the intake conduit 300, the inverted pump 400, the discharge conduit 600, the motor 700, and one or more sensors. The annular space provides passage for wellbore fluid that may enter the shroud 800. Fluid in the annular space may further flow through interiors of the production pump 200, the intake conduit 300, the inverted pump 400, and the discharge conduit 600 and, afterwards, flow out the one or more exit ports 802 of the shroud 800. In other words, the production pump 200, the intake conduit 600, the inverted pump 400, and the discharge conduit 600 are conduits that provide passage for any wellbore fluid flowing in the shroud 800.

The production pump 200, the intake conduit 300, the inverted pump 400, the packer 500, the discharge conduit 600, and the motor 700, each has a rotatable shaft assembly disposed therein (see FIGS. 2-6). Each shaft assembly is rotatably coupled to one or more bearings that are coupled to inner surfaces of a respective component. Furthermore, the shaft assemblies are coupled in series to form one long shaft assembly. For example, the shaft assemblies in the production pump 200, the intake conduit 300, the inverted pump 400, the packer 500, the discharge conduit 600, and the motor 700 are coupled to form one long shaft assembly. Moreover, rotation of any one shorter, individual shaft assembly would rotate the entire shaft assembly. For example, the long shaft assembly may be rotated by the motor 700 because a shorter shaft assembly disposed in the motor.

Figure 2:
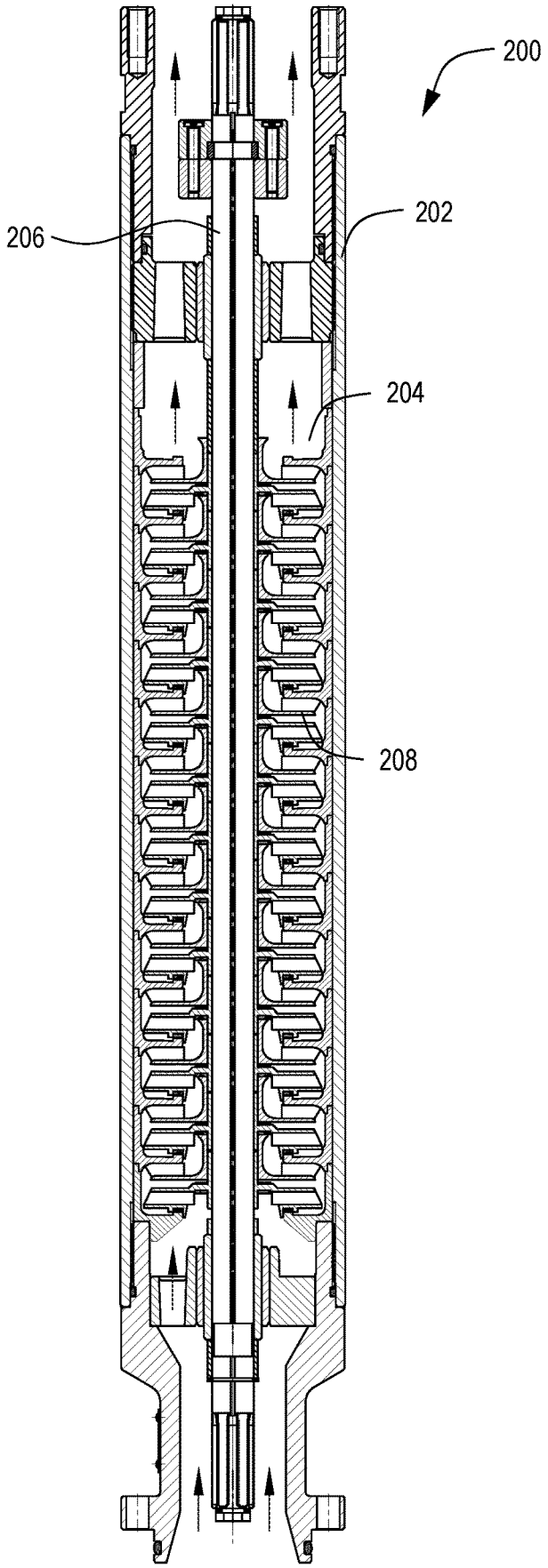
FIG. 2 illustrates a cross-sectional side view of a production pump.
Figure 4:
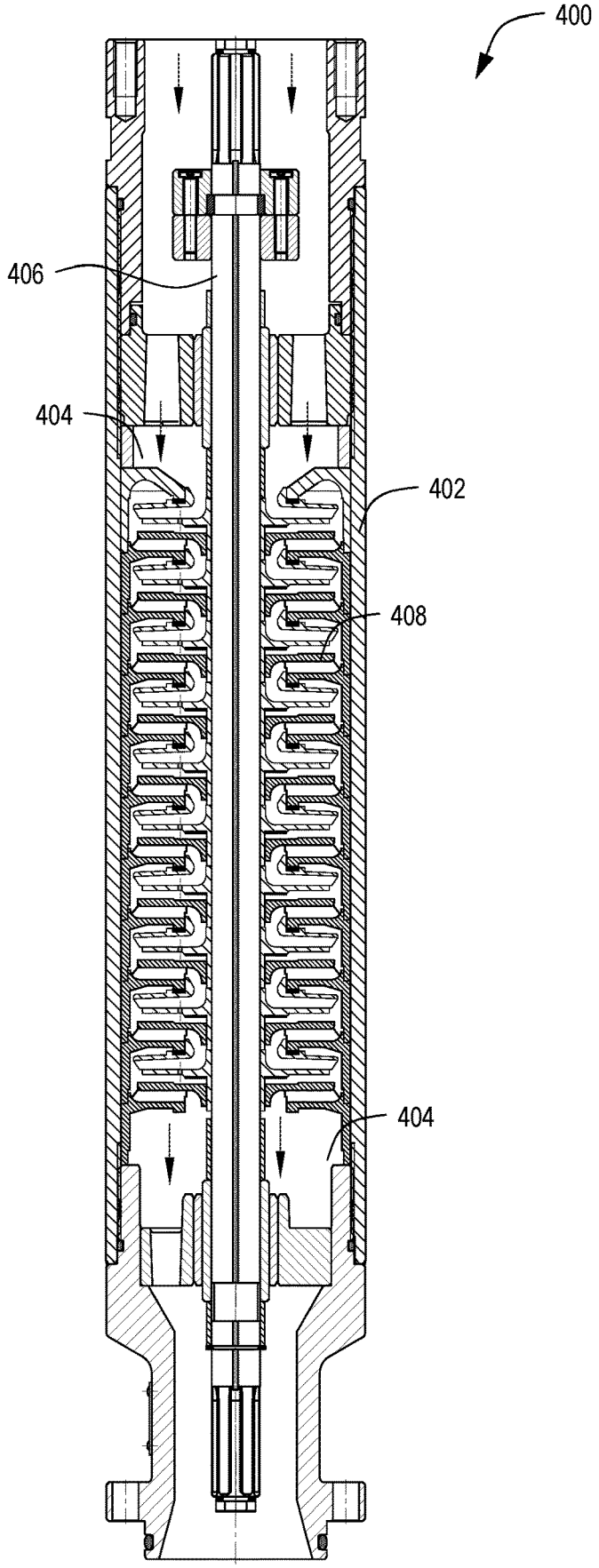
FIG. 4 illustrates a cross-sectional side view of an inverted pump.

Additionally, the shaft assemblies in the production pump 200 and the inverted pump 400 each include impellers (see FIG. 2 and FIG. 4). The impellers in the production pump 200 and the inverted pump 400 are sized, shaped, and configured to push fluid, e.g., hydrocarbon, through the respective production pump 200 and inverted pump 400. Preferably, the impeller in the production pump 200 are angled relative to the central axis of the production pump 200 to push fluid towards surface, e.g., upwardly. Whereas the impeller in the inverted pump 400 are angled relative to the central axis of the inverted pump 400 to push fluid further downhole, e.g., downwardly.

FIG. 2 illustrates a cross-sectional side view of a production pump 200. The production pump 200 of FIG. 2 may be used with the ESP assembly 100 of FIG. 1. The production pump 200 may receive fluid flowing therethrough. The production pump 200 includes a production pump housing 202 having an inner surface and an outer surface. The production pump housing 202 surrounds internal components and assemblies. The inner surface of the production pump housing 202 defines a fluid reservoir 204 that is configured to receive wellbore fluid, e.g., hydrocarbon. The fluid reservoir 204 has an upper end and a lower end. Arrows in FIG. 2 indicate fluid flow through the fluid reservoir 204 from the lower end towards the upper end of the production pump 200.

A body is disposed within and is coupled to the production pump housing 202. The body includes several internal components coupled together. When assembled and coupled to the production pump housing 202, the internal components form the body inside the production pump housing 202. The assembled components align to form a fluid reservoir 204 in the body. As indicated by arrows in FIG. 2, fluid may flow through the fluid reservoir 204.

A shaft assembly is disposed within the internal assembly in the fluid reservoir 204. The shaft assembly includes a shaft 206, and impeller 208 coupled to the outer surface of the shaft 206.

The impeller 208 is coupled to the shaft 206. Additionally, the impeller 208 is disposed in the fluid reservoir 204. Thus, as fluid flow through the fluid reservoir 204 and across the impeller 208, the flowing fluid would cause the impeller 208 to rotate. Accordingly, the shaft 206 would also be rotated.

Rotation of the impeller 208 may produce an area of low pressure above the impeller 208 and an area of high pressure below the impeller 208, thereby creating differential pressure in the fluid reservoir 204. The differential pressure may cause fluid to flow in a path from the area of high pressure to the area of low pressure, as indicated by arrows in FIG. 2.

The upper end of the production pump 200 has an opening for fluid to exit the production pump 200. Thus, fluid flowing through the fluid reservoir 204 may exit the production pump housing 202 through the opening.

Figure 3:
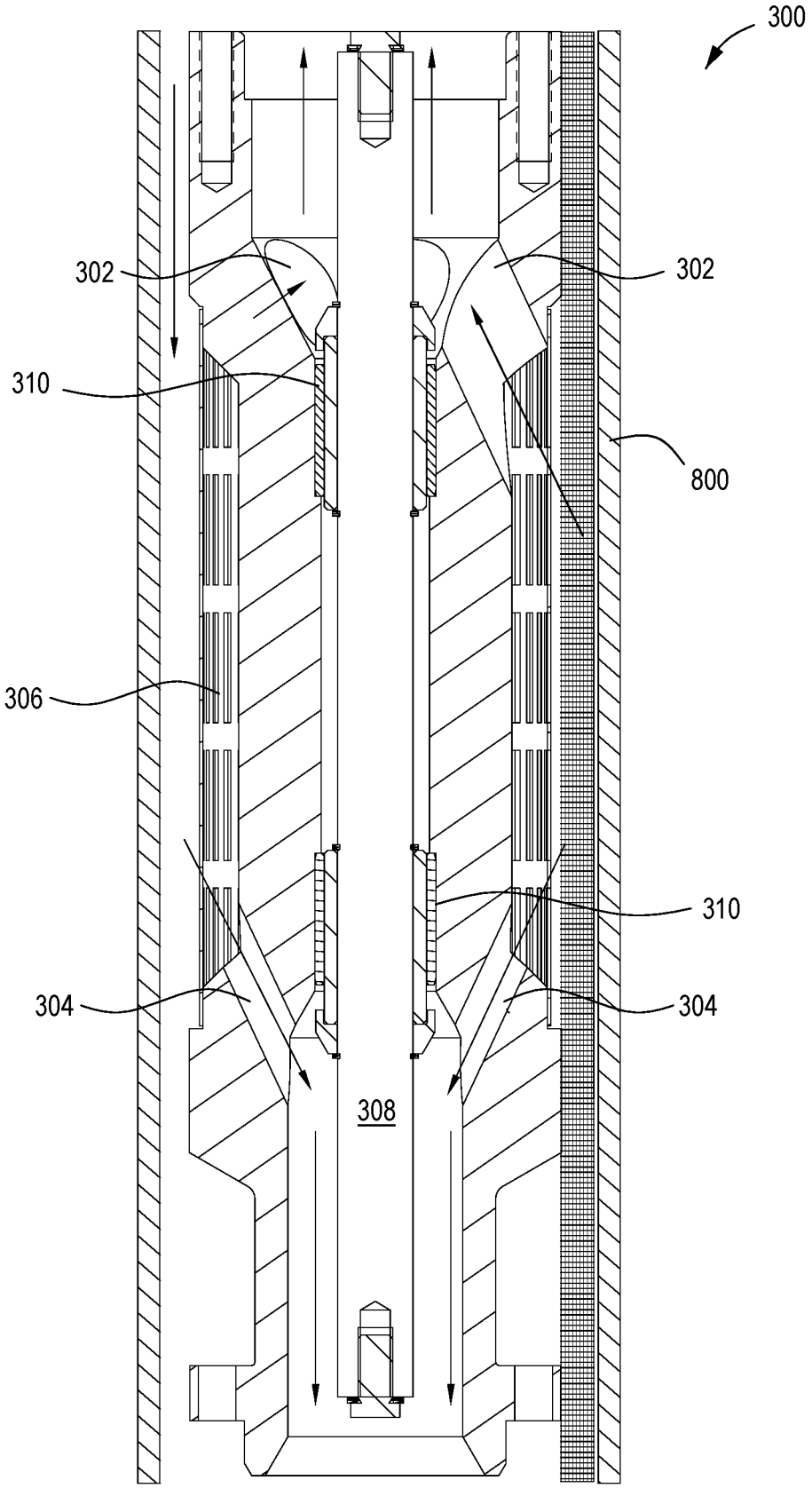
FIG. 3 illustrates a cross-sectional side view of an intake conduit disposed in a shroud.

FIG. 3 illustrates a cross-sectional side view of an intake conduit 300 disposed in a shroud 800. The intake conduit 300 of FIG. 3 may be used with the ESP assembly 100 of FIG. 1. The intake conduit 300 is a cylindrical body having a borehole extending therethrough. In addition, the intake conduit 300 has one or more upper entry ports 302 and one or more lower entry ports 304 that are in fluid communication with the borehole.

The one or more upper entry ports 302 extend through the body of the intake conduit 300 at an angle to the central axis of the of the intake conduit 300. The one or more lower entry ports 304 also extend through the cylindrical body of the intake conduit 300 at an angle, e.g., 90 degrees or less, to the central axis of the of the intake conduit 300. However, the direction the one or more upper entry ports 302 extends, e.g., upwardly, is opposite to the one or more lower entry ports 304 extends, downwardly. Thus, when fluid flow through the one or more upper entry ports 302, the fluid would flow in an upwardly direction. Conversely, fluid flow through the one or more lower entry ports 304, the fluid would flow in an upwardly direction.

Additionally, each upper entry port 302 has a diameter greater than a diameter of each lower entry port 304. Thus, more fluid could flow through an upper entry port 302 a lower entry port 304.

A screen 306 is disposed around the one or more upper entry ports 302 and the one or more lower entry ports 304. The screen 306 has one or more slits disposed therethrough. The one or more slits are size, shaped, and configured to allow fluid to flow through the screen 306 but inhibit debris larger than the one or more slits from passing through.

A shaft assembly is disposed in the borehole of the intake conduit 300. The shaft assembly includes a shaft 308 and one or more bearings 310. The shaft 312 is rotatably coupled to the one or more bearings 310 such that the shaft 312 is rotatable relative to the intake conduit 300.

FIG. 4 illustrates a cross-sectional side view of an inverted pump 400. The inverted pump 400 of FIG. 4 may be used with the ESP assembly 100 of FIG. 1. The inverted pump 400 may receive fluid flowing therethrough. The inverted pump 400 includes an inverted pump housing 402 having an inner surface and an outer surface. The inverted pump housing 402 surrounds internal components and assemblies. The inner surface of the inverted pump housing 402 defines a fluid reservoir 404 that is configured to receive wellbore fluid, e.g., hydrocarbon. The fluid reservoir 404 has an upper end and a lower end. Arrows in FIG. 4 indicate fluid flow through the fluid reservoir 404 from the upper end towards the lower end of the inverted pump 400.

A body is disposed within and is coupled to the inverted pump housing 402. The body includes several internal components coupled together. When assembled and coupled to the inverted pump housing 402, the internal components form the body inside the inverted pump housing 402. The assembled components align to form a fluid reservoir 404 in the body. As indicated by arrows in FIG. 4, fluid may flow through the fluid reservoir 404.

A shaft assembly is disposed within the internal assembly in the fluid reservoir 404. The shaft assembly includes a shaft 406, and an impeller 408 coupled to the outer surface of the shaft 406.

The impeller 408 is coupled to the shaft 406. Additionally, the impeller 408 is disposed in the fluid reservoir 404. Thus, as fluid flow through the fluid reservoir 404 and across the impeller 414, the flowing fluid would cause the impeller 408 to rotate. Accordingly, the shaft 406 would also be rotated.

Rotation of the impeller 408 may produce an area of high pressure above the impeller 408 and an area of low pressure below the impeller 408, thereby creating differential pressure in the fluid reservoir 404. The differential pressure may cause fluid to flow in a path from the area of high pressure to the area of low pressure, as indicated by arrows in FIG. 4.

The lower end of the inverted pump 400 has an opening for fluid to exit the inverted pump 400. Thus, fluid flowing through the fluid reservoir 404 may exit the inverted pump housing 402 through the opening.

Figure 5:
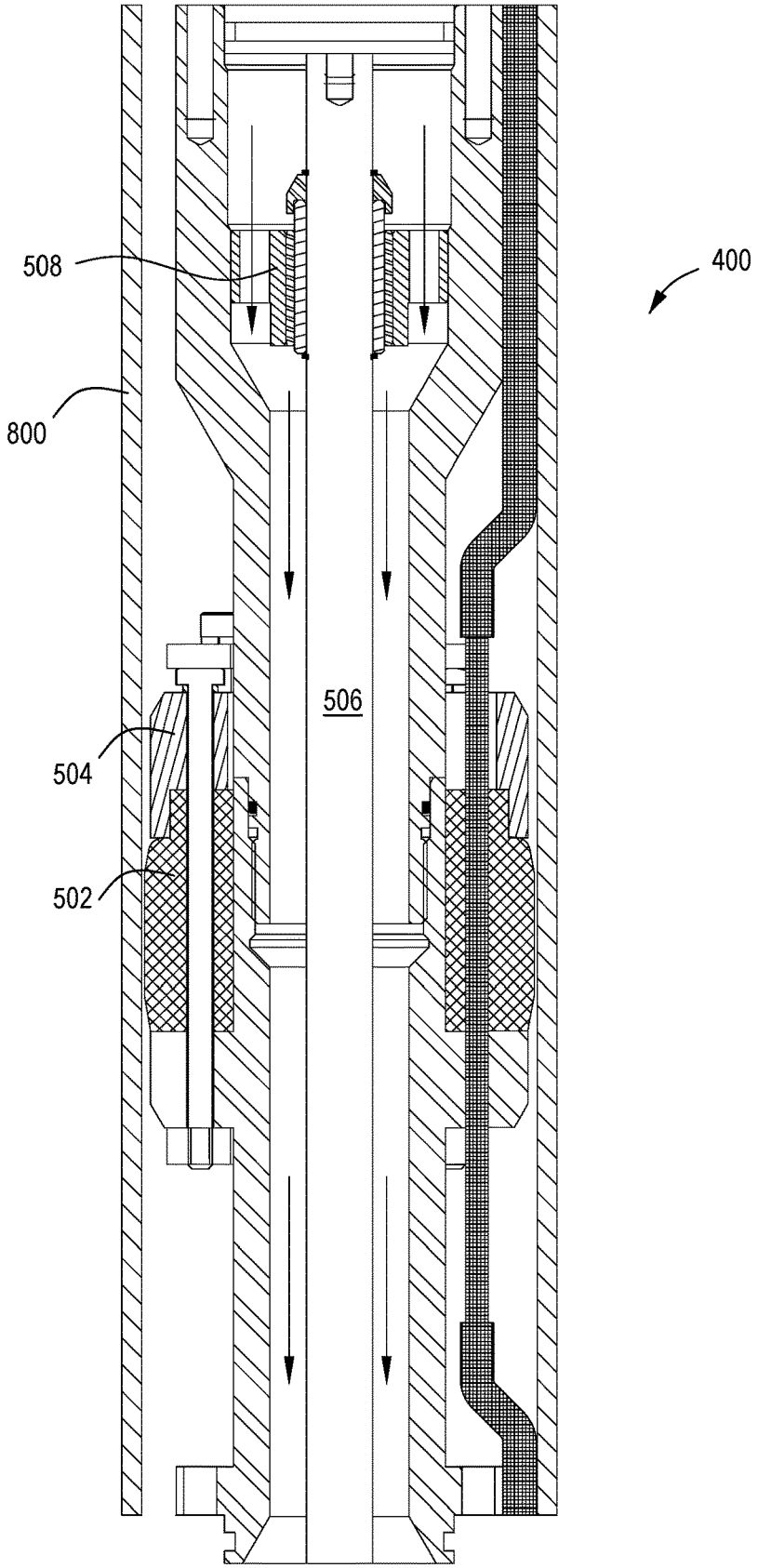
FIG. 5 illustrates a cross-sectional side view of a packer disposed in a shroud.

FIG. 5 illustrates a cross-sectional side view of a packer 500 disposed in a shroud 800. The packer 500 of FIG. 5 may be used with the ESP assembly 100 of FIG. 1. The packer 500 is a cylindrical body having a borehole extending therethrough. The packer 500 includes a seal 502 and a bracket 504 . . . . The bracket 504 may be tightened to cause the seal 502 to bulge outward. Thus, the bulging seal 502 is abutted against internal surfaces of the cylindrical body and is compressed against a motor lead extension, e.g., power cable, traveling through the seal 502.

A shaft assembly is disposed in the borehole of the packer 500. The shaft assembly includes a shaft 506 and one or more bearings 508. The shaft 506 is rotatably coupled to the one or more bearings 508 such that the shaft 506 is rotatably relative to the packer 500.

Figure 6:
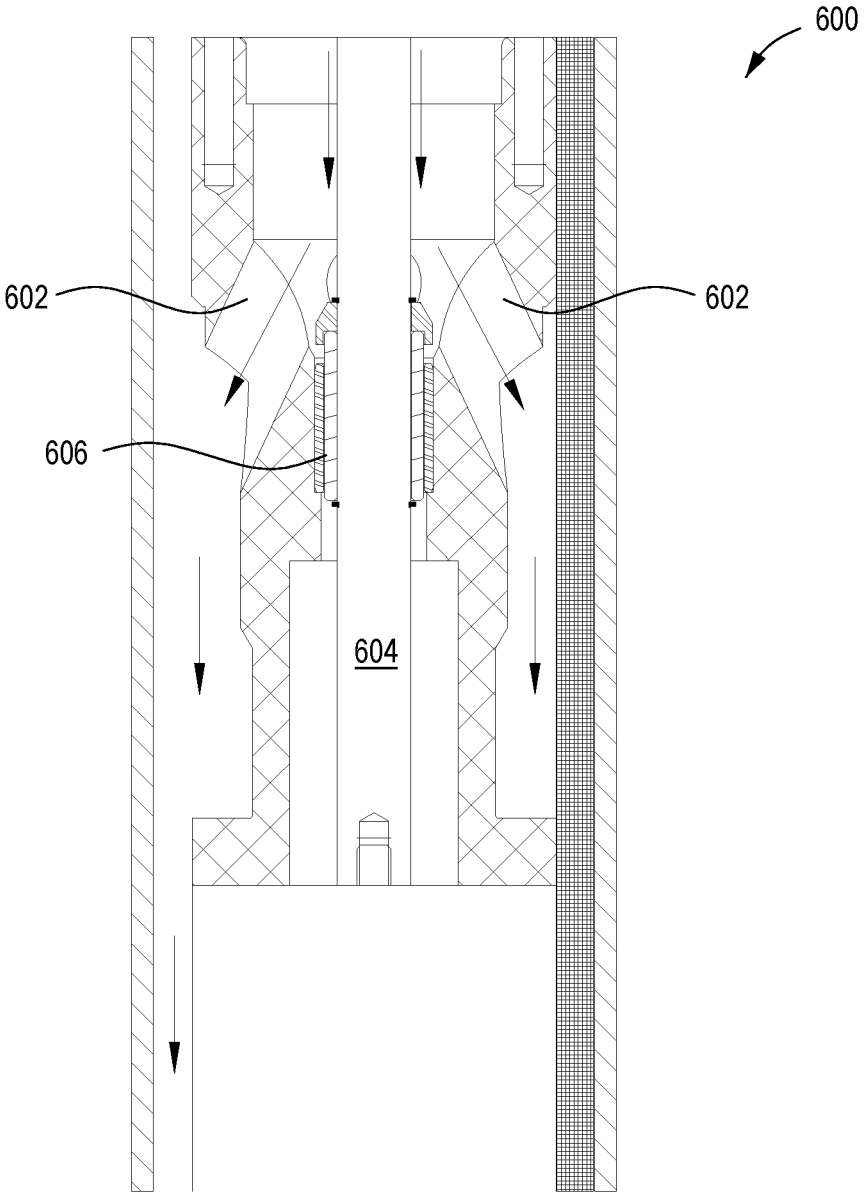
FIG. 6 illustrates a cross-sectional side view of a discharge conduit disposed in shroud.

FIG. 6 illustrates a cross-sectional side view of a discharge conduit 600 disposed in shroud 800. The discharge conduit 600 of FIG. 6 may be used with the ESP assembly 100 of FIG. 1. The discharge conduit 600 is a cylindrical body having a borehole extending therethrough. In addition, the discharge conduit 600 has one or more discharge ports 602 that are in fluid communication with the borehole. The one or more discharge ports 602 extend through the cylindrical body of the discharge conduit 600 at an angle, e.g., 90 degrees or less, to the central axis of the of the discharge conduit 600. Preferably, the one or more discharge ports 602 extends in downwardly direction. Thus, when fluid flow through the one or more e discharge ports 602, the fluid would flow in a downwardly direction.

A shaft assembly 604 is disposed in the borehole of the discharge conduit 600. The shaft assembly includes a shaft 604 and one or more bearings 606. The shaft 604 is rotatably coupled to the one or more bearings 606 such that the shaft 604 is rotatably relative to the discharge conduit 600.

Referring to FIGS. 1-6, operation of an ESP assembly 100 in a downhole wellbore is as follow. First, fluid from an underground reservoir (not shown) may enter the wellbore through perforations (not shown) created in a casing 102 that lines the wellbore. Pressure in the wellbore is lower than pressure in the underground reservoir, so the wellbore fluid would migrate into the casing 200 until pressure in the wellbore and the underground reservoir equalizes. Next, an operator may lower an ESP assembly 100 into wellbore fluid that have entered the wellbore, which would then enter and fill the ESP assembly 100. The ESP assembly 100 has an outer diameter smaller than an inner diameter of the casing 102; therefore, a first annular space would exist between the ESP assembly 100 and the casing 102. Preferably, the ESP assembly 100 is disposed above the perforations in the casing 102 but is submerged in the wellbore fluid. Then, the operator may actuate the production pump 200 and the inverted pump 400 to cause wellbore fluid to be drawn into the ESP assembly 100.

As shown by the arrows in FIGS. 1-6, the actuated production pump 200 and inverted pump 400 would draw upwardly fluid that would have entered the casing 102 from the perforations (not shown) below the ESP assembly 100. The fluid would flow upwardly through the first annular space between the wellbore and the outside surfaces of the shroud 800. At an upper edge of the shroud 800, the wellbore fluid would then flow through an opening in the upper portion of the shroud 800 and down a portion of the second annular space that is disposed between inner surfaces of the shroud 800 and a string formed by the production pump 200 the intake conduit 400. Because the wellbore fluid may be multiphase (e.g., including liquid hydrocarbon, solid debris entrained in the liquid hydrocarbon, and gas), mostly liquid hydrocarbon (having solid debris) would flow down the portion of the second annular space towards the intake conduit 300. Lighter gas from the wellbore fluid would separate from the liquid hydrocarbon and would continue rising upwardly pass the shroud 800. The rising gas may be collected in a receptacle (not shown) disposed above the ESP assembly 100.

Because a seal 502 of a packer 500 is pressed against the shroud 800, the liquid hydrocarbon cannot flow pass the seal 502 in the second annular space. The portions of the seal 502 that are pushed against the shroud 800 may inhibit fluid flow pass the seal 502. Accordingly, the portions of the seal 502 that are pushed against the shroud 800 would divide a second annular space disposed between the shroud 800 and a string formed by a production pump 200, an intake conduit 300, an inverted pump 400, a packer 500, a discharge conduit 600, and a motor 700. Accordingly, the liquid hydrocarbon may only flow through the intake conduit 300.

At the intake conduit 300, the liquid hydrocarbon may flow through one or more slits in a screen 306 that is disposed around a cylindrical body of the intake conduit 300. The one or more slits in the screen 306 are sized, shaped, and configured to filter certain solid debris entrained in the liquid hydrocarbon from passing through.

For the liquid hydrocarbon that may flow through the screen 306, a first portion of the liquid hydrocarbon may flow through one or more upper entry ports 302 and a second portion of the liquid hydrocarbon may flow through one or more lower entry ports 304. Each upper entry port 302 has a diameter greater than a diameter of each lower entry port 304. Accordingly, more volume of liquid hydrocarbon could flow through the upper entry ports 302 than volume of liquid hydrocarbon that could flow through the lower entry ports 304.

For liquid hydrocarbon that may flow through the one or more upper entry ports 302, the production pump 200 would pump the liquid hydrocarbon towards surface, e.g., via tubing coupled to the production pump 200.

For liquid hydrocarbon that may flow through the one or more lower entry ports 304, the inverter pump 400 would pump the liquid hydrocarbon down and through a borehole of the packer 800 into a discharge conduit 600. The liquid hydrocarbon would exit one or more discharge ports 602 disposed in the discharge conduit 600. The liquid hydrocarbon would further flow down the second annular space and across outer surfaces of the motor 700.

During operation, the motor 700 may generate heat. If not dissipated, the heat could damage the motor 700. Thus, liquid hydrocarbon that flow across the outer surfaces of the motor 700 may be used to absorb heat generated by the motor 700. The heated liquid hydrocarbon may flow away from the motor 700; thereby, carrying heat away from the motor 700.

Furthermore, the heated liquid hydrocarbon may flow out of the shroud 800 through exit ports 116 disposed in the shroud 800. After exiting the shroud 800, the heated liquid hydrocarbon may mix with cooler wellbore fluid that may have entered the casing 102 from the reservoir.

What is claimed as the invention is:

1. An electric submersible pump assembly for pumping fluids from a wellbore, comprising:

a shroud that comprises:

a first shroud aperture; and a second shroud aperture;

a first pump disposed in the shroud, wherein the first pump is capable of pumping wellbore fluid that has flowed through the first shroud aperture; and a second pump disposed in the shroud, wherein the second pump is capable of pumping out of the second shroud aperture wellbore fluid that has flowed through the first shroud aperture;

wherein the first shroud aperture is capable of receiving wellbore fluid that exited the second shroud aperture.

2. The electric submersible pump assembly of claim 1, further comprising a shaft rotatably coupled to the first pump and the second pump.

3. The electric submersible pump assembly of claim 1, wherein the first pump and the second pump are disposed between the first shroud aperture and the second shroud aperture.

4. The electric submersible pump assembly of claim 1, wherein the second pump is below the first pump.

5. The electric submersible pump assembly of claim 1, wherein the first pump is capable of pumping wellbore fluid away from the second pump.

6. The electric submersible pump assembly of claim 1, wherein the second pump is capable of pumping wellbore fluid away from the first pump.

7. The electric submersible pump assembly of claim 1, wherein the first pump is capable of pumping wellbore fluid in a first direction and the second pump is capable of pumping wellbore fluid in a second direction that is opposite the first direction.

8. An electric submersible pump assembly for pumping fluids from a wellbore, comprising:

a shroud that comprises:

a first shroud portion; and a second shroud portion;

a first pump disposed in the shroud, wherein the first pump is capable of pumping wellbore fluid past the first shroud portion; and a second pump disposed in the shroud wherein the second pump is capable of pumping wellbore fluid out through the second shroud portion;

wherein the first shroud portion is capable of receiving wellbore fluid that exited the second shroud portion.

9. The electric submersible pump assembly of claim 8, wherein the first shroud portion has a first shroud aperture through which wellbore fluid is capable of flowing into the shroud.

10. The electric submersible pump assembly of claim 8, wherein the second shroud portion has a second shroud aperture through which wellbore fluid is capable of flowing out of the shroud.

11. The electric submersible pump assembly of claim 8, wherein the first pump is between the first shroud portion and the second pump.

12. The electric submersible pump assembly of claim 8, wherein the second pump is between the first pump and the first shroud portion.

13. An electric submersible pump assembly for pumping fluids from a wellbore, comprising:

a shroud that comprises:

a first shroud aperture; and a second shroud aperture;

a first pump disposed in the shroud;

a second pump disposed in the shroud, wherein the second pump is capable of pumping wellbore fluid out of the second shroud aperture;

a motor; and a shaft rotatably coupled to the motor, the first pump, and the second pump;

wherein the first shroud aperture is capable of receiving wellbore fluid that exited the second shroud aperture.

14. The electric submersible pump assembly of claim 13, wherein the motor is below the second pump.

15. The electric submersible pump assembly of claim 13, wherein the second pump is capable of pumping out of the second shroud aperture wellbore fluid that has flowed through the first shroud aperture.

* * * * *